US008951606B2

(12) United States Patent
Hertter et al.

(10) Patent No.: US 8,951,606 B2
(45) Date of Patent: Feb. 10, 2015

(54) METHOD FOR PRODUCING A COMPONENT BY CALCULATING A LOAD LINE OF THE COMPONENT

(75) Inventors: Manuel H. Hertter, Munich (DE); Andreas Jakimov, Munich (DE); Marcin Olbrich, Unterschleissheim (DE); Mihaela-Sorina Seitz, Munich (DE); Juergen Kraus, Karlsfeld (DE); Bertram Kopperger, Dachau (DE); Klaus Broichhausen, Groebenzell (DE); Hans Banhirl, Dorfen (DE); Erwin Bayer, Dachau (DE); Wolfgang Werner, Rohrbach (DE); Eberhard Knodel, Jetzendorf-Priel (DE)

(73) Assignee: MTU Aero Engines GmbH, Munich (DE)

( * ) Notice: Subject to any disclaimer, the term of this patent is extended or adjusted under 35 U.S.C. 154(b) by 67 days.

(21) Appl. No.: 13/577,876

(22) PCT Filed: Jan. 29, 2011

(86) PCT No.: PCT/DE2011/000083

§ 371 (c)(1), (2), (4) Date: Nov. 30, 2012

(87) PCT Pub. No.: WO2011/098065

PCT Pub. Date: Aug. 18, 2011

(65) Prior Publication Data

US 2013/0084421 A1 Apr. 4, 2013

(30) Foreign Application Priority Data

Feb. 11, 2010 (DE) ..... 10 2010 007 526

(51) Int. Cl.

| | |
|---|---|
| ***B05D 1/02*** | (2006.01) |
| ***B05D 1/32*** | (2006.01) |
| ***C23C 24/04*** | (2006.01) |
| ***F01D 5/28*** | (2006.01) |

(52) U.S. Cl.

CPC . *B05D 1/02* (2013.01); *C23C 24/04* (2013.01); *F01D 5/288* (2013.01)

USPC ..... 427/202; 427/282; 427/421.1

(58) Field of Classification Search

USPC ..... 427/202, 282, 421.1

See application file for complete search history.

(56) References Cited

U.S. PATENT DOCUMENTS

| | | | | |
|---|---|---|---|---|
| 6,365,222 | B1 | 4/2002 | Wagner et al. | |
| 6,905,728 | B1 * | 6/2005 | Hu et al. | 427/142 |
| 2009/0092498 | A1 * | 4/2009 | Jabado et al. | 416/241 R |

FOREIGN PATENT DOCUMENTS

EP 1 808 508 A1 7/2007

OTHER PUBLICATIONS

PCT/DE2011/000083 PCT/ISA/210, dated Jun. 8, 2011, 2 pages.

* cited by examiner

*Primary Examiner* — Frederick Parker

(74) *Attorney, Agent, or Firm* — Crowell & Moring LLP

(57) ABSTRACT

A method for producing a component is disclosed. The method includes calculating a load line of the component as a result of a load to be absorbed by the component and applying a layer on a core by gas dynamic cold spraying, where the layer has a layer section and where the layer section runs along the calculated load line.

9 Claims, 2 Drawing Sheets

METHOD FOR PRODUCING A COMPONENT BY CALCULATING A LOAD LINE OF THE COMPONENT

This application claims the priority of International Application No. PCT/DE2011/000083, filed Jan. 29, 2011, and German Patent Document No. 10 2010 007 526.4, filed Feb. 11, 2010, the disclosures of which are expressly incorporated by reference herein.

BACKGROUND AND SUMMARY OF THE INVENTION

The invention relates to a method for producing a component and a component produced in such a way.

In the case of heavily stressed components such as, for example, blades of compressors or turbines, rotating components such as crankshafts, components with cyclical loads such as connecting rods, components of a static type with high thermal stress such as, for example, cooling structures as well as in the case of tools, it is frequently necessary to make a compromise between different and opposing requirements. Examples of this are high fatigue strength with a low weight or low brittleness with great hardness.

In order to meet these opposing requirements, the components are increasing being produced from metal alloys, which are only able to be processed to a limited extent using conventional production methods. In addition, it is disadvantageous that, for the most part, the entire base body of the component is made of this metal alloy so that individual component regions are not able to be optimized individually depending upon the load that occurs. Moreover, most of the time the metal alloy is restricted to a consideration of structural properties such as fatigue strength and weight. To achieve, for example, a high level of abrasion resistance or temperature resistance, the component is usually coated with a corresponding protective layer, which is applied during a subsequent and therefore additional production method. Thus, for example U.S. Pat. No. 6,365,222 B1 proposes coating a blade ring of a compressor with an abradable protective layer using gas dynamic cold spray. In doing so, a bonding layer is first applied to the base body and then the protective layer. In addition, gas dynamic cold spray for repairing turbine blades is also known from U.S. Pat. No. 6,905,728 B1. In this case, chips are filled with a corresponding material using gas dynamic cold spray and then the blade regions repaired in this manner are strengthened.

However, the disadvantage of the aforementioned gas dynamic cold spray method is that the applied layers are able to positively influence only external properties such as temperature resistance and abrasion resistance of the component. Structural properties such as an increase in the fatigue strength cannot be achieved with known gas dynamic cold spray methods. An additional disadvantage is that the conventional production methods greatly limit the shape or geometry of the components, which in turn may have a disadvantageous impact on component properties.

The object of the present invention is creating a method for producing a component, which eliminates the aforementioned disadvantages and which has individualized component regions adapted to a respective load, and a component produced in this manner having optimized component regions.

In the case of a method according to the invention for producing a component, at least one load line of the component is calculated. Then a core for the component is made available. Finally, a layer is applied on the core at least in sections by gas dynamic cold spray, wherein at least one layer section is produced in the layer, the material and orientation of the layer section being selected according to the load line.

The advantage of the method according to the invention is that it is possible to optimally dimension the component in accordance with its required properties. The core is virtually used merely as the substrate or carrier for the layer, in which the required properties are integrated based on the different materials and taking the respective load lines into consideration. Thus, for example component regions having a high fatigue strength may be made of a different material and have a different geometry than component regions having a high temperature resistance. According to the invention, a hybrid-like layer is created, which is optimally adapted to the mechanical loads so that it is also possible to combine actually opposing requirements in an optimal manner. It is no longer necessary to provide and fasten separate structural reinforcing structures. Due to the type of gas dynamic cold spray technique according to the invention, relatively soft and virtually organic transitions spilling over into each other are created between the different materials. Transitions of this type prevent a formation of steps and therefore make a harmonic load initiation and load distribution in or over the component possible. Another advantage is that only one production method is used to form the component and namely gas dynamic cold spray. Therefore, the use of several different methods is not required.

In the case of one exemplary embodiment, the layer is applied in different layer thicknesses. This allows a flexible design of the component shape or of component areas independent of the shape and size of the core. In doing so, the layer thickness may definitely range in the centimeter range so that for example rib-like reinforcing elements are produced.

Producing the layer section may be carried out strip-like in a width corresponding to a coverage distribution of a sprayed stream or by means of a mask covering the areas during spraying on which no material is supposed to be applied.

In the case of one exemplary embodiment, several layer sections are applied, the interstices of which are filled at least sporadically with a different material. An optimal load structure is hereby produced, the progression of which corresponds to the load lines, wherein the material in the interstices serves to stabilize the layer sections along with purely leveling them out.

In the case of one exemplary embodiment, a plurality of layers is applied. Thus it is conceivable for example to apply a top layer that defines a closed surface or outer surface of the component.

To achieve a final contour, the component may undergo an abrasive and/or strengthening post-processing.

A component according to the invention has a core, which has, at least in sections, a layer applied by gas dynamic cold spray. According to the invention, the layer has at least one layer section, the material and orientation of which are selected according to at least one calculated load line.

Such a component has optimum component properties and can be produced in almost in every shape or having every geometry.

The layer preferably surrounds the core completely so that the material and the shape of the core are almost freely selectable and the core may be designed for example to be optimized in terms of weight and/or have optimal adhesion conditions for the layer to be applied.

A plurality of layer sections is preferably provided for forming a load structure, which are able to form dendritic and/or organic structural sections for harmonic load initiation and load distribution.

In the case of one exemplary embodiment, the materials of at least some structural sections differ. The materials may hereby be adjusted individually to the loads.

The core, which may be both surface-like as well as skeletal or scaffold-like, may be made of almost any material. In the case of one exemplary embodiment, it is made of a different material or different materials than the layer.

Other advantageous exemplary embodiments are the subject matter of further dependent claims.

In addition, the method according to the invention may also be used, if, for example, components need to be labeled without negatively affecting the strength properties thereof. Examples of this are the tamper-proof labeling of metallic or hybrid components with a manufacturer's logo or serial numbers. The method according to the invention may likewise be used in the aesthetic or practical design of everyday articles such as knife blades and jewelry.

Preferred exemplary embodiments of the invention are explained in greater detail in the following on the basis of schematic representations.

DETAILED DESCRIPTION OF THE DRAWINGS

The same reference numbers are used in the figures to identify the same structural elements, wherein for the sake of clarity if there are several of the same structure elements in one figure, only one element is provided with a reference number.

Figure 1:
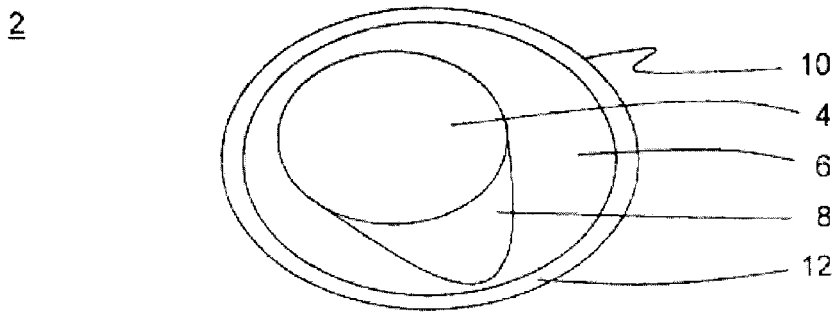
FIG. 1 is a cross section through a first component according to the invention.

FIG. 1 shows a cross section through a very simplified component 2 according to the invention. The component 2 has a full-body-like core 4, which is sheathed by a layer 6. The layer 6 was applied by gas dynamic cold spray and according to the invention absorbs the actual load of the component 2. It has a nose-like load structure 8 extending away from the core 4 and running along calculated load lines such as tension and force lines. The layer 6 is applied in different layer thicknesses and to form a closed surface 10, is surrounded by a top layer 12 having a constant layer thickness, which was also applied using gas dynamic cold spray.

The layer thicknesses and the materials of the layer 6, the load structure 8 and the top layer 12 are selected in accordance with the loads to be absorbed and may consequently vary. The core 4 is used primarily as a substrate for the layer 6 and consequently has a core material, which is selected virtually independently of the loads to be absorbed. Due to the sheathing of the core 4 with the layer 6 or the top layer 12, the outer contour of the core has no influence in principle on the target geometry or final contour of the component 2. This is defined exclusively by the layer 6 or the top layer 12.

Figure 2:
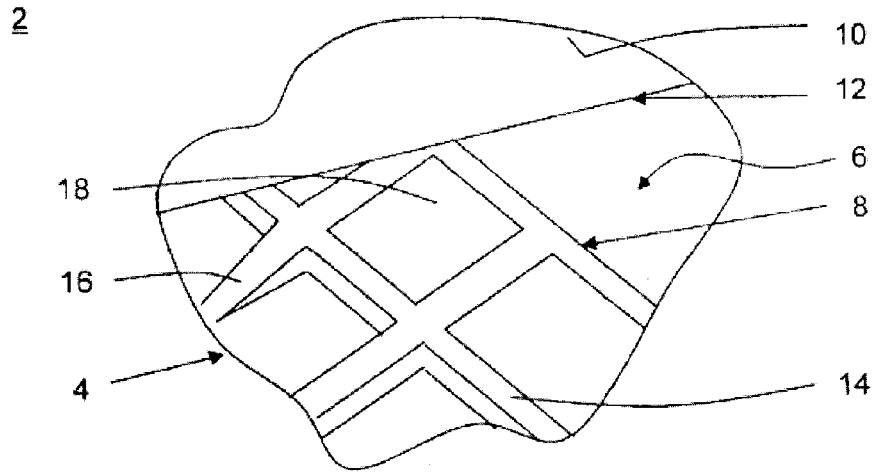
FIG. 2 is a detailed representation of the component from FIG. 1.

FIG. 2 shows a top view of a partial area of the component 2 according to the invention in the region of another load structure 8 (not shown in FIG. 1), which runs along load lines. The load structure 8 extends away from the core 4 and has a plurality of layer sections 14 or reinforcing elements, which are applied by gas dynamic cold spray. The material of the respective layer section 14 is selected according to the loads to be absorbed. Similarly, its geometry corresponds to the to-be-expected load and may vary individually. As an example, a free end section 16 of the load structure 8 is designed to be triangular or ramp-like and merges steplessly into the core 4. The layer sections 14 delimit interstices 18, which are filled with a different material than the layer sections 14 by using gas dynamic cold spray. The load structure 8 with the filled interstices 18, i.e., the layer 6, is sheathed by the top layer 12 to form the closed surface 10 as FIG. 1 illustrates.

Figure 3:
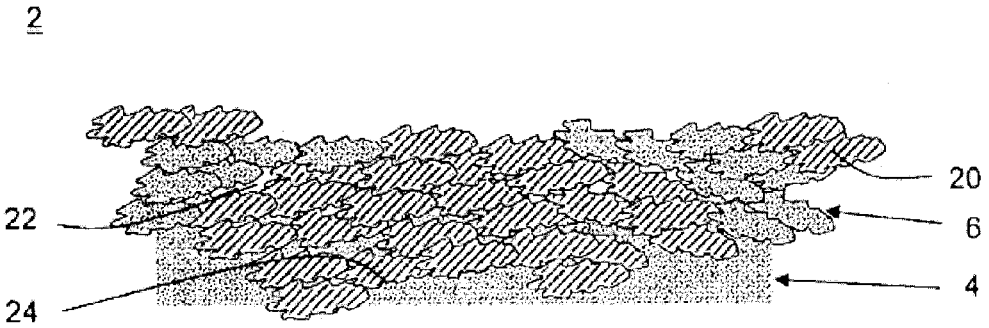
FIG. 3 is another detailed representation of the component from FIG. 1.

According to FIG. 3, the layer 6 in cross section has a plurality of approximately oval layer bodies 20 with projections on the circumferential side, which are made of different materials according to the load lines and are arranged in relation to one another corresponding to the load lines. The different materials are depicted in FIG. 3 by different shading, either striped or dotted. Because of the use of the gas dynamic cold spray technique according to the invention the layer bodies 20 appear to intermesh and, in doing so, form relatively soft and organic transitions, which has an advantageous effect on the initiation or absorption and distribution of the load on the component 2. Depending on the function of the respective layer area, air chambers 22 form sporadically in a targeted manner between the layer bodies 20. The air chambers 22 may be designed in a target manner for example to influence the damping behavior or the heat transfer.

Furthermore, FIG. 3 shows that the uneven locations 24 in the core 4 of the component 2 are equalized by the layer 6, and that the layer bodies 20 likewise assume an apparently intermeshed connection with the core 4.

Figure 4:
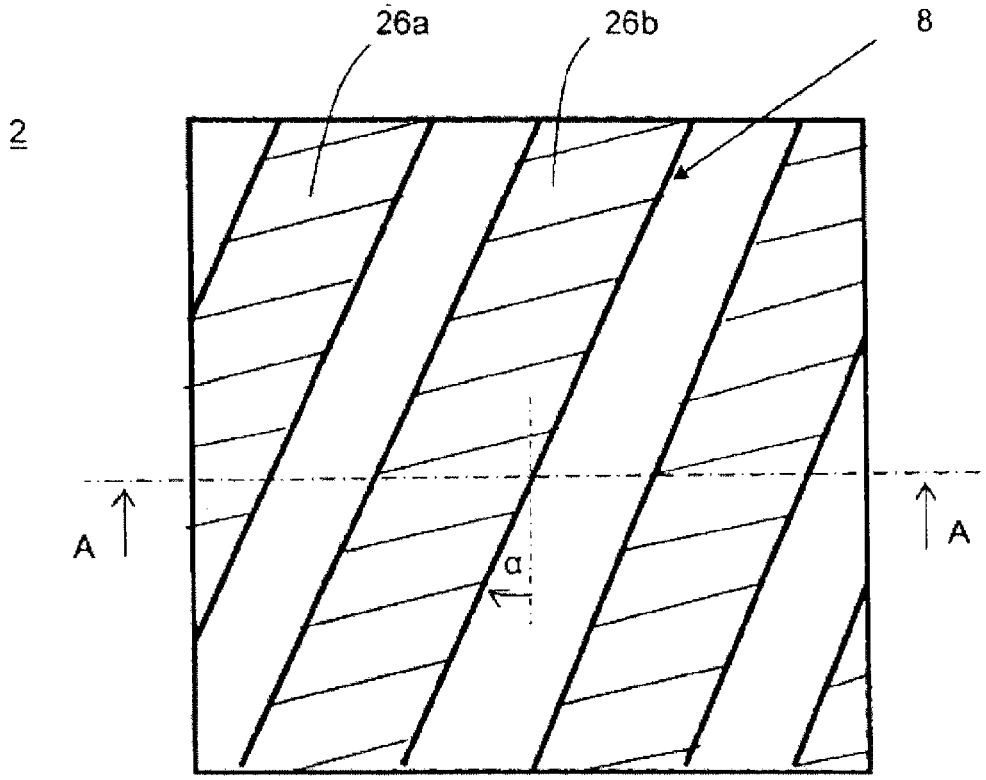
FIG. 4 is a longitudinal section through a second component according to the invention.
Figure 5:
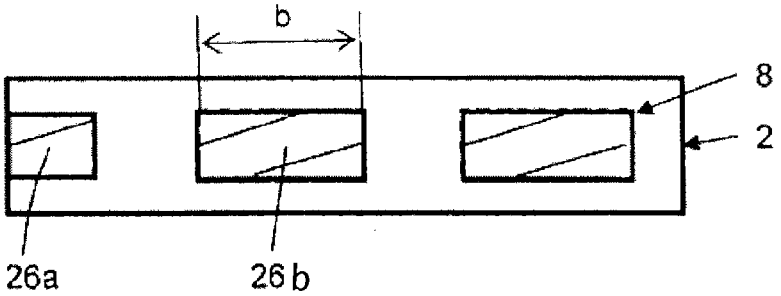
FIG. 5 is a cross-section through the component from FIG. 4 along line A-A.

FIGS. 4 and 5 depict sections through a second component 2 according to the invention. The component has a discrete load structure 8, which is formed by a plurality of rib-like reinforcing elements 26*a*, 26*b* or layer sections that are spaced apart from one another and run parallel to each other. The reinforcing elements 26*a*, 26*b* have a rectangular cross section and extend to optimally adjust the component 2 with respect to its strength, its vibration behavior and for example its temperature behavior along the load and force lines that are to be expected or that occur. In the depicted exemplary embodiment, the reinforcing elements 26*a*, 26*b* are therefore lined up at an angle $\alpha$ to the longitudinal axis of the component. They are applied in layers by gas dynamic cold spray, wherein their width b preferably corresponds to the coverage angle of the sprayed stream. As the shading indicates, they are made of a different material than the basic material or the core material of the component 2 and are fully enclosed in the basic material or sheathed thereby. The material of the reinforcing elements 26*a*, 26*b* depends upon the loads that are to be expected or that occur.

Figure 6:
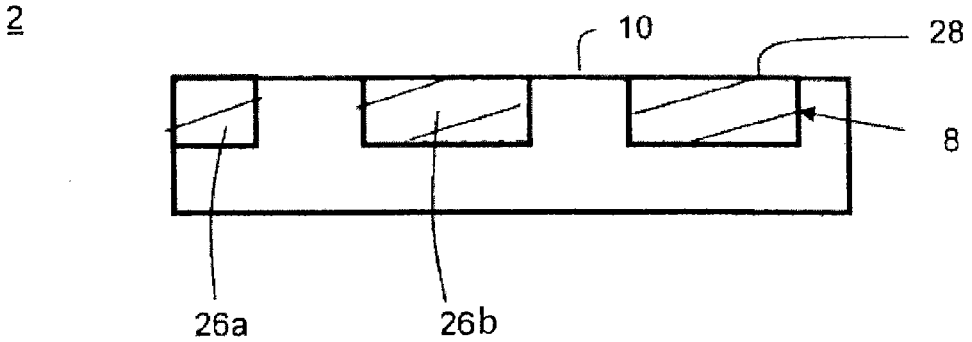
FIG. 6 is a cross-section through a third component according to the invention.

FIG. 6 shows a cross-section through a third component 2 according to the invention, the load structure 8 of which forms the surface 10 of the component 2 in sections from a plurality of rib-like reinforcing elements 26*a*, 26*b* or layer sections having a rectangular cross section that are spaced apart from one another and run parallel to each other. For this, the reinforcing elements 26 are configured in the component 2 or integrated therein in such a way that one of their outer surfaces 28 is exposed and merges flush with the surface 10 of the component 2. Because of the different materials between the basic material of the component 2 and the material of the reinforcing elements 26*a*, 26*b*, this exemplary embodiment is suitable in particular for forming the component 2 with zonelike different levels of surface hardness and/or abrasion resistance. Naturally, the reinforcing elements 26*a*, 26*b* may also be made of different materials.

In the case of a method according to the invention for producing the component 2 from FIGS. 1 to 3, first the load lines of the component 2 are determined as a result of, for example, forces to be absorbed, vibrations or temperatures. Then the core 4 is made available from a core material, wherein the core 4 already has such a surface quality that cleaning or corresponding surface treatments are dispensed with. Now the layer 6 is formed on the core 4 using gas dynamic cold spray. In the process, the load structure 8 is aligned along the computed load lines and a material that is suitable for the respective load is used. A spray gun with a spray cone is preferably used, which corresponds to the width of the respective layer section 14 or the reinforcing element 26*a*, 26*b*. After the load structure 8 is produced, the interstices 18 between the layer sections 14 are filled with the core material by gas dynamic cold spray. Then the top layer 12 is sprayed on the layer 6 using gas dynamic cold spray to form a closed surface 10 made of the core material. Finally, to achieve a correspondingly resilient final contour, the component 2 undergoes a post-processing in the form of an abrasive and/or strengthening method.

Other methods according to the invention provide a different material than the core material as the material for filling the interstices 18 or as the material for the top layer 12. The selection of the respective material for filling the interstices 18 and the top layer 12 depends in particular upon the function to be fulfilled such as, for example, improving damping properties, abrasion resistance or temperature resistance.

A component is disclosed, which has a layer applied by gas dynamic cold spray, the layer having at least one layer section or a reinforcing element, the material and orientation of which are selected according to a load line, as well as a method for producing such a component by gas dynamic cold spray.

The invention claimed is:

1. A method for producing a component, comprising the steps of:

calculating a load line of the component as a result of a load to be absorbed by the component; and applying a layer on a core by gas dynamic cold spraying, wherein the layer has a layer section and wherein the layer section runs along the calculated load line.

2. The method according to claim 1, wherein the layer is applied in different layer thicknesses.

3. The method according to claim 1, wherein the step of applying the layer includes producing the layer section in a width corresponding to a coverage distribution of a sprayed stream.

4. The method according to claim 1, wherein the step of applying the layer includes producing the layer section by applying a mask during spraying.

5. The method according to claim 1, wherein the layer has a plurality of layer sections and wherein the plurality of layer sections define a plurality of interstices which are filled with a material that is different from a material of the plurality of layer sections.

6. The method according to claim 1, further comprising the step of applying a plurality of layers on the core.

7. The method according to claim 1, further comprising the step of applying a top layer on the layer, wherein the top layer forms an outer surface of the component.

8. The method according to claim 1, further comprising the step of forming a final contour of the component by an abrasive and/or strengthening post-processing.

9. The method according to claim 1, wherein the layer section is a reinforcing element.

* * * * *